US007332681B2

(12) United States Patent
Wohlfart

(10) Patent No.: US 7,332,681 B2
(45) Date of Patent: Feb. 19, 2008

(54) MODULAR OPERATING SWITCH ASSEMBLY

(75) Inventor: Karl-Heinz Wohlfart, Bodman-Ludwigshafen (DE)

(73) Assignee: TRW Automotive Electronics & Components GmbH & Co. KG, Radolfzell (DE)

( * ) Notice: Subject to any disclaimer, the term of this patent is extended or adjusted under 35 U.S.C. 154(b) by 0 days.

(21) Appl. No.: 11/484,054

(22) Filed: Jul. 11, 2006

(65) Prior Publication Data

US 2007/0012550 A1 Jan. 18, 2007

(30) Foreign Application Priority Data

Jul. 13, 2005 (DE) ..... 20 2005 011 033 U

(51) Int. Cl.
*H01H 13/70* (2006.01)

(52) U.S. Cl. ..... 200/5 A; 200/517; 200/345

(58) Field of Classification Search ..... 200/5 R, 200/5 A, 18, 520, 293, 296, 341, 344, 345, 200/310, 313, 314; 341/22; 345/168–170; 361/680; 400/472, 486, 489, 490, 496
See application file for complete search history.

(56) References Cited

U.S. PATENT DOCUMENTS

| | | | | |
|---|---|---|---|---|
| 4,376,879 | A | 3/1983 | Nagata et al. | |
| 4,459,439 | A * | 7/1984 | Hehl | 200/5 A |
| 4,564,732 | A * | 1/1986 | Lancaster et al. | 200/307 |
| 5,032,698 | A * | 7/1991 | Satoh | 200/341 |
| 5,581,251 | A * | 12/1996 | McRight et al. | 341/22 |
| 5,668,358 | A * | 9/1997 | Wolf et al. | 200/5 A |
| 5,747,758 | A * | 5/1998 | Hochgesang et al. | 200/5 A |
| 5,907,612 | A * | 5/1999 | Aggus et al. | 379/368 |
| 6,140,593 | A * | 10/2000 | Bramesfeld et al. | 200/5 A |
| 6,759,613 | B2 * | 7/2004 | Kurihara | 200/314 |
| 2002/0144884 | A1 | 10/2002 | Kurihara | |

FOREIGN PATENT DOCUMENTS

| | | |
|---|---|---|
| DE | 2516527 | 10/1976 |
| DE | 29903967 | 6/1999 |
| DE | 20110871 | 10/2001 |
| DE | 10134895 | 1/2003 |
| EP | 0312112 | 4/1989 |
| EP | 1000834 | 5/2000 |
| EP | 1445087 | 8/2004 |
| EP | 1460665 | 9/2004 |
| WO | 98/15963 | 4/1998 |

* cited by examiner

*Primary Examiner*—Michael A Friedhofer
(74) *Attorney, Agent, or Firm*—Tarolli, Sundheim, Covell & Tummino LLP

(57) ABSTRACT

A modular operating switch assembly comprises a housing defining a plurality of switch operating cells. Each of the operating cells has guide walls, a switch actuating member in sliding contact with the guide walls, and a switch contact carrier configured to be selectively equipped with contact pairs such that each of the contact pairs is associated with at least one said switch actuating member. Each switch actuating member is operable to be selectively connected to a key cap associated with a single switch operating cell, or with a key cap associated with a plurality of adjacent switch operating cells.

18 Claims, 25 Drawing Sheets

FIG. 1
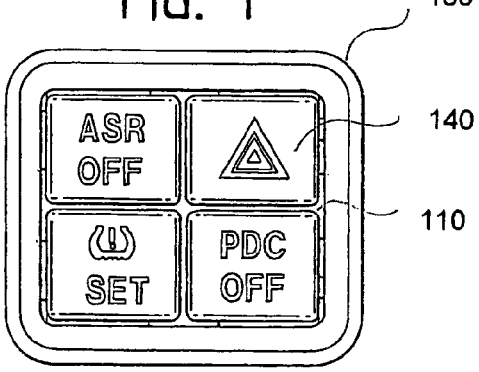
FIG. 2
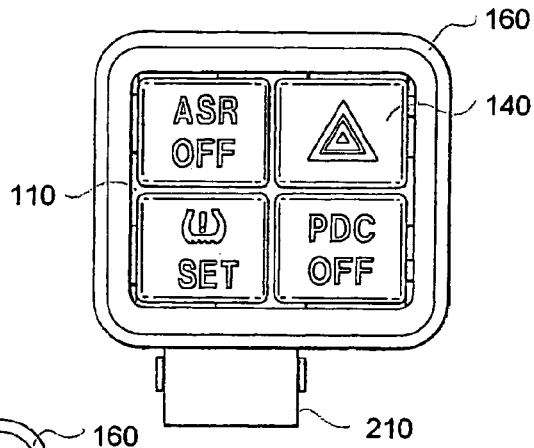
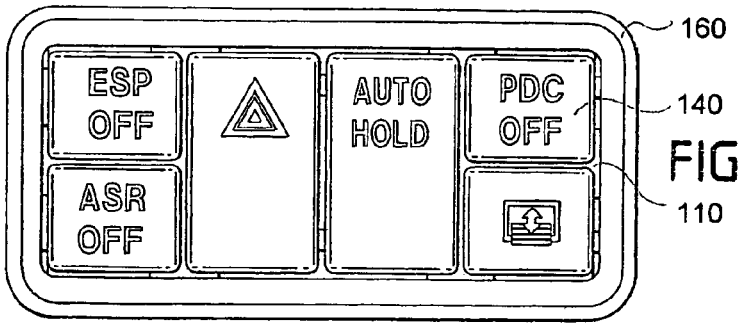
FIG. 3
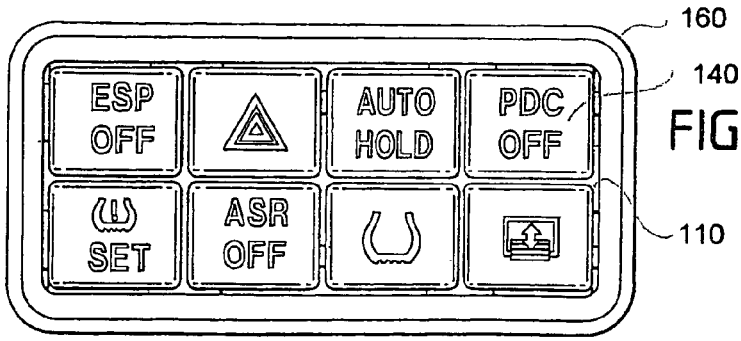
FIG. 4

FIG. 17
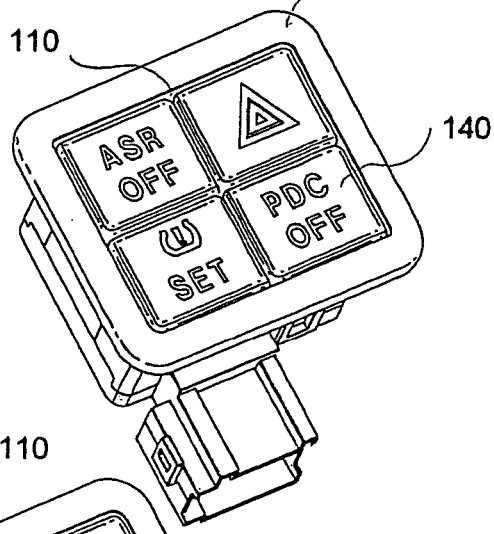
FIG. 16
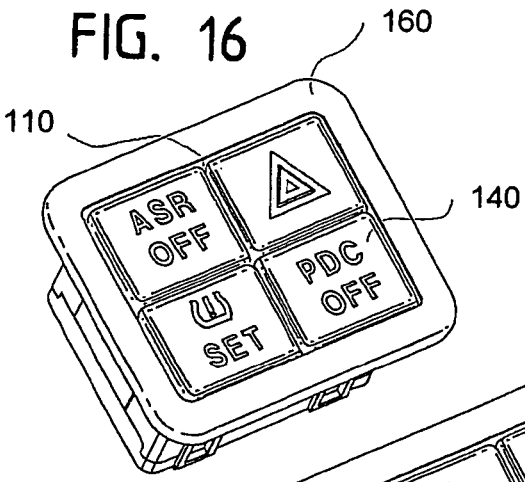
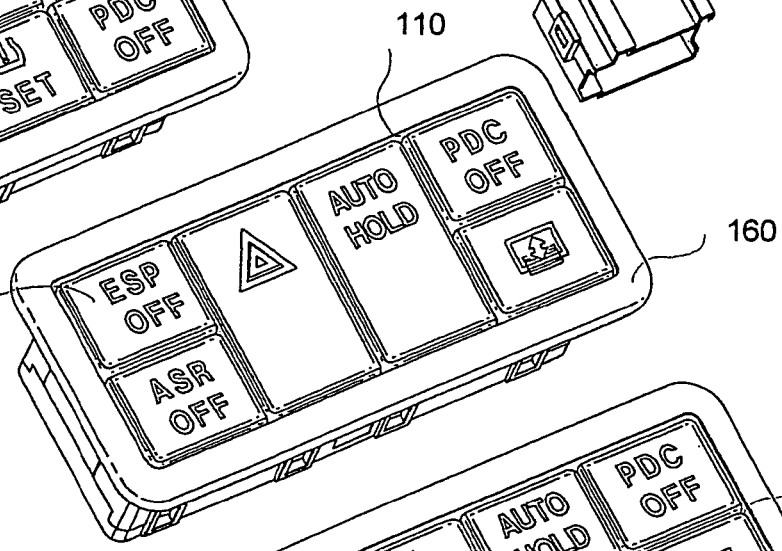
FIG. 18
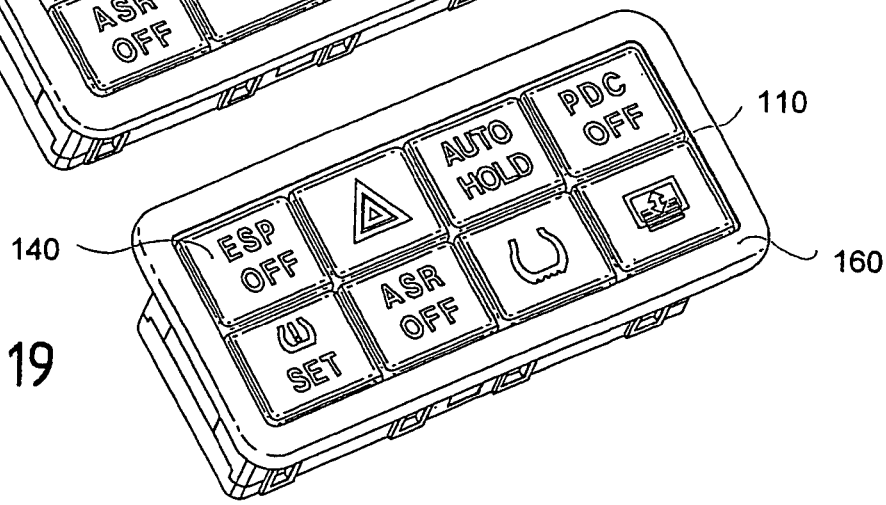
FIG. 19

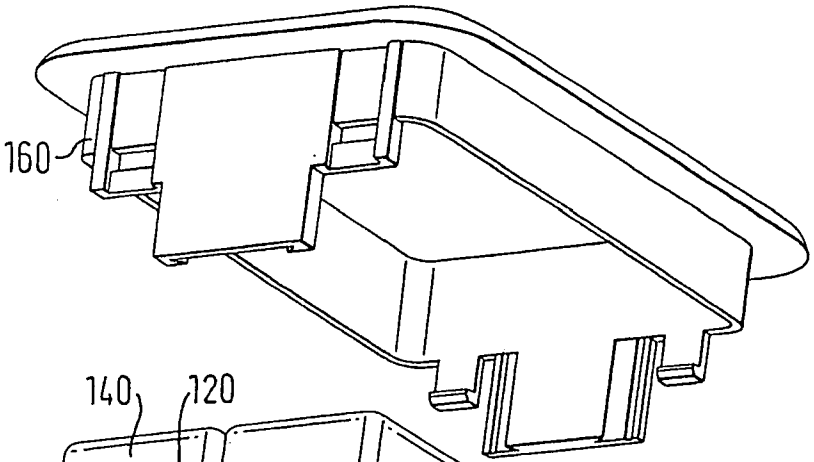
FIG. 37
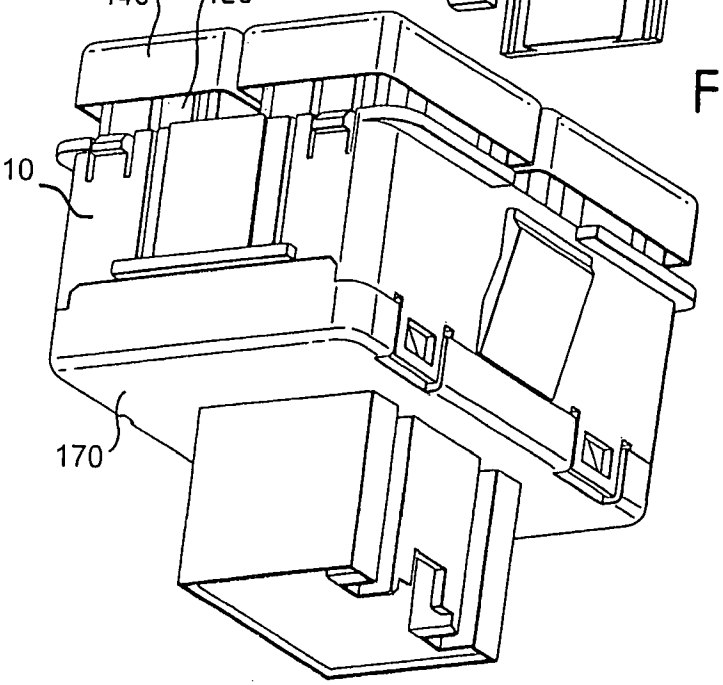
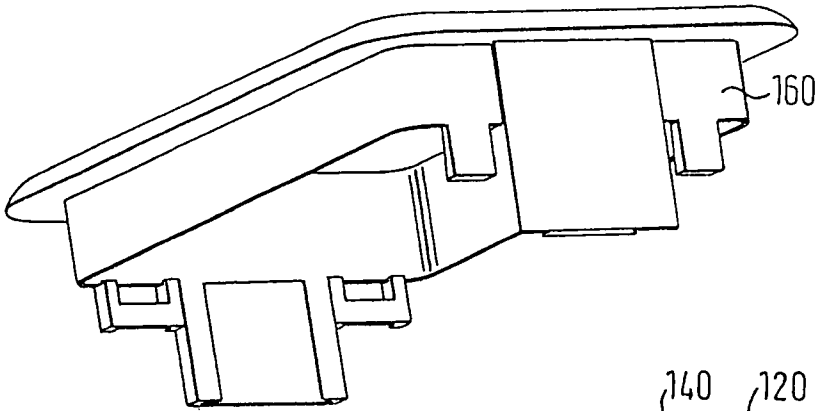
FIG. 36
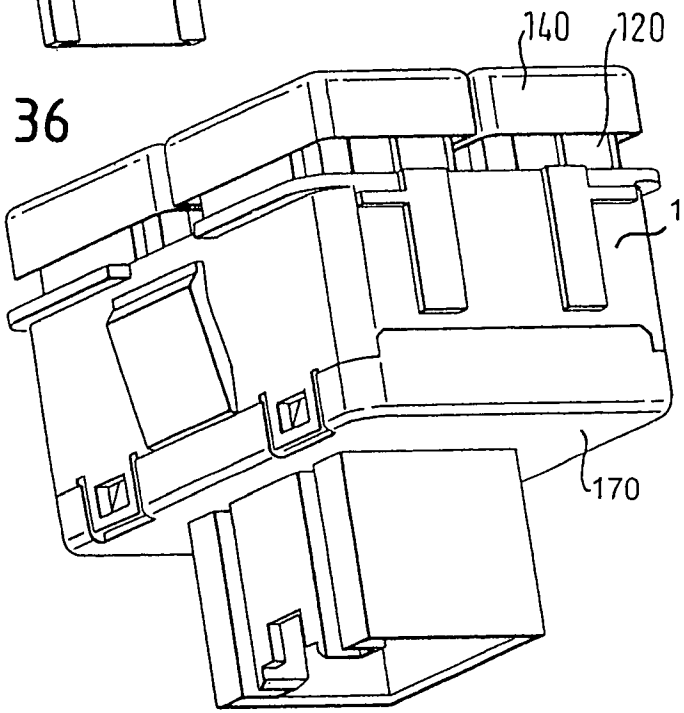

MODULAR OPERATING SWITCH ASSEMBLY

FIELD OF THE INVENTION

The present invention generally relates to a modular operating switch assembly for use in a vehicle.

BACKGROUND OF THE INVENTION

Vehicles have operating elements which are constructed as switches or as keys to operate various functions. A greater or lower number of such operating elements are necessary, depending on the equipment of a vehicle. In so far as vehicles do not have the entire special equipment with respect to possible operating elements, so-called blind caps are used in place of the operating elements which are not required. This has the disadvantage that, when these blind caps are used in place of the operating elements, it can be seen immediately that a vehicle does not have all the special equipment or that at least particular functions are missing.

There can also be problems with the reliability of such operating switches. If an electrical contact in an operating switch is contaminated or faulty, a user cannot operate the function associated with that operating switch.

SUMMARY OF THE INVENTION

The invention provides a modular operating switch assembly. The assembly comprises a housing that defines a plurality of switch operating cells. Each of the operating cells has guide walls, a switch actuating member in sliding contact with the guide walls, and a switch contact carrier configured to be selectively equipped with contact pairs. Each of the contact pairs is associated with at least one switch actuating member and each switch actuating member is operable to be selectively connected to either a key cap associated with a single switch operating cell or with a key cap associated with a plurality of adjacent switch operating cells.

It is possible hereby that the key cap (also designated as "operating key" or "cap") may be connected with several switch actuating members (also designated as "guide elements"). Thereby each guide element may observe both an individual functionality (key function or switch function), and also several guide elements may be combined into one single functionality via a common operating key. The operating element therefore also does not have any blind caps when it is occupied by a differing number of (switch or key) functionalities. A vehicle without blind caps gives a more individualized, and thus more exclusive, impression than a vehicle which has blind caps. In particular, it is not immediately obvious that optimal functionalities are not present in the vehicle.

This also enables a more reliable operating switch to be provided. When a switch actuating member is located in a switch operating cell that is not associated with a particular functionality (when one key cap is associated with a plurality of adjacent switch operating cells) the "redundant" contact pair associated with that actuating member can be employed as an extra pair of contacts for a single functionality. Thus if one of the contact pairs becomes faulty or contaminated, switching of the functionality need not be affected.

The operating element may be used in various applications, in particular in fittings or operating units, in particular in modes of transport, e.g. in vehicles.

Preferably, the housing comprises several guide elements or is designed for several guide elements. Advantageously, two, four, six or eight guide elements may be provided. In particular, the housing comprises several openings, one each for a guide element respectively.

The guide element can be constructed as a reflector. In this case, the reflector is suitable for directing light, i.e. it may be illuminated for example from the side facing away from the operating key. A function illumination of the operating key is thereby made possible by means of the photoconducting characteristic of the reflector. The operating key may itself preferably contain an indicating mark for this which is arranged for example so as to be transparent on a non-transparent (upper) surface of the operating key. The mark on the operating key is illuminated through the photoconducting functionality of the reflector. The operator, for example the driver of a motor vehicle, can therefore recognize the functionality of the operating key even in darkness.

Furthermore, status illumination (activation illumination) may be additionally provided for the operating key. This illumination is preferably constructed separately in addition to the function illumination and indicates the active status of a function which is associated with the operating key. For example, in the case of an activated warning blinker system, the possibly red status illumination can be switched on and off in time with the blinker lights. To do this, the status illumination is to be separated optically from the function illumination. This occurs for example through suitable optical channels inside the guide element.

The guide element can be a slider. In particular, the housing can have an individual opening for each guide element, i.e. each guide element or slider is displaceably arranged in the opening of the housing which is provided for it.

A further development consists in that two contact elements are provided per operating key and therefore a reliability of contact is ensured through redundantly arranged contacts. If a contact element is contaminated, the electrical connection can be produced via the additional contact element. Furthermore, a stable guidance of the guide element or a stable suspension of the contact element can be ensured in particular through two contact elements.

Alternatively, more than two contact elements may also be provided per operating key. Also, only one contact element may be provided per operating key.

According to a further embodiment, provision is made that several guide elements are connected with one operating key. It is thereby possible for blind caps to be effectively avoided. If, for example, one guide element is "superfluous" in an operating element with four guide elements, because only three operating keys are necessary, one large operating key can be connected with two guide elements so that the operating element which is actually designed for four operating keys has a total of three operating keys but no blind cap.

An electrical connection can be produced on a plate with the aid of the at least one contact element. The plate is preferably connected with the at least one contact element, for example by means of a closure element. In particular, this connection may be a connection which is brought about by means of contact or under a small amount of pressure.

A further development consists in that at least one contact element is a rubber element or a snap element. In this way, it is possible that the switch functionality or the key functionality of the respective operating part is able to be felt. The operating element logically comprises several operating parts, each operating part in turn comprising a guide element, an operating key and at least one contact element.

Both the rubber element and also the snap element bring about the contacting of the operating part and also the (e.g. elastic) restoring thereof. Therefore, an elastic switching can be made possible with the aid of the at least one contact element.

The at least one contact element can comprise a small carbon plate, which causes an electrical contact on the plate when the operating part is activated, and can also comprise a switch point. The user is able to feel this switch point by means of the operating key, i.e. on actuating the operating key, he notices that when the switch point is exceeded the respective switch- or key function has been triggered.

A frame element may be provided that is able to be connected with the housing and which encloses at least one operating key.

Preferably, at least one key function and/or at least one switch function is able to be carried out with the aid of the operating element. In particular, the operating element may comprise at least one key and/or at least one switch.

The invention further relates to an assembled operating element comprising several operating elements as described above, the housings being connected with each other. In particular, the housings can be constructed so as to be plugged together; a possible plug connection is a "dovetail" joint.

In this way, parts of the assembled operating element, e.g. the frame element and/or the plate and/or the closure element can be constructed in one piece, i.e. suitable for the respective assembled operating element.

Further characteristics and advantages of the invention ensue from the description below of the preferred embodiments, and from the accompanying drawings, in which:

BRIEF DESCRIPTION OF THE DRAWINGS

FIG. 1 to FIG. 11 show respectively an operating element with a different number of operating keys from the viewpoint of the operator;

FIG. 12 to 21 show various oblique views of operating elements;

FIG. 36 and FIG. 37 show oblique views of a partial exploded view of the operating element;

DESCRIPTION OF THE PREFERRED EMBODIMENTS

Figure 6:
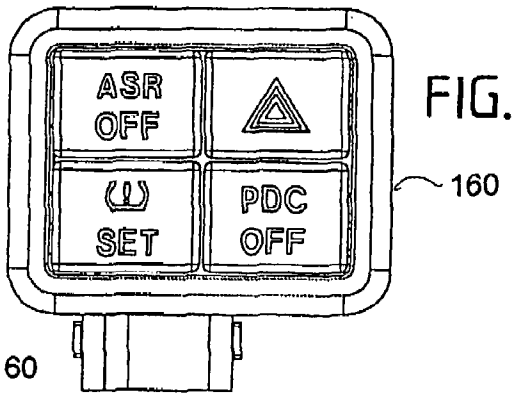
Figure 5:
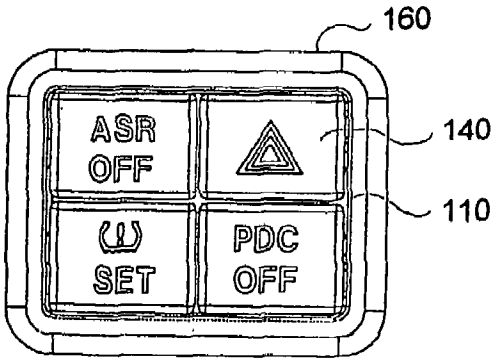
Figure 7:
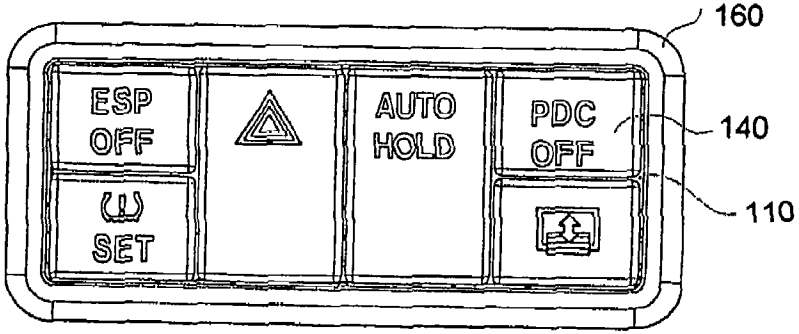
Figure 8:
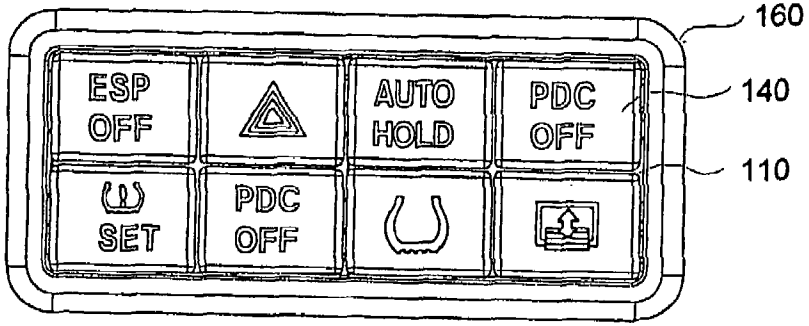
Figure 9:
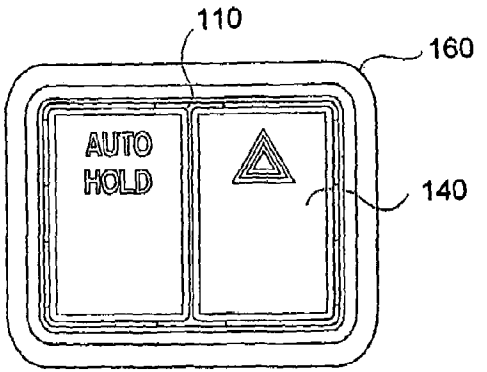
Figure 10:
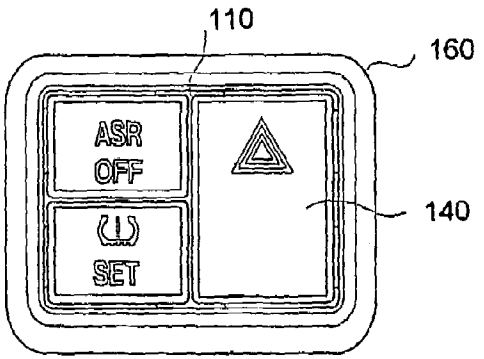
Figure 11:
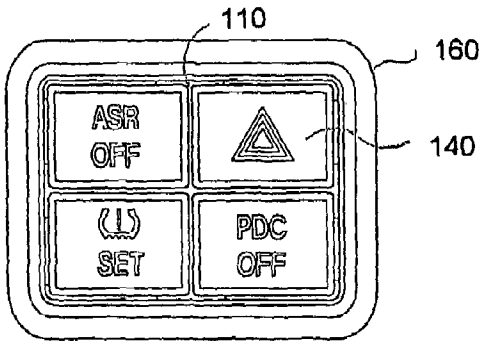
Figures 12, 13, 14, 15:
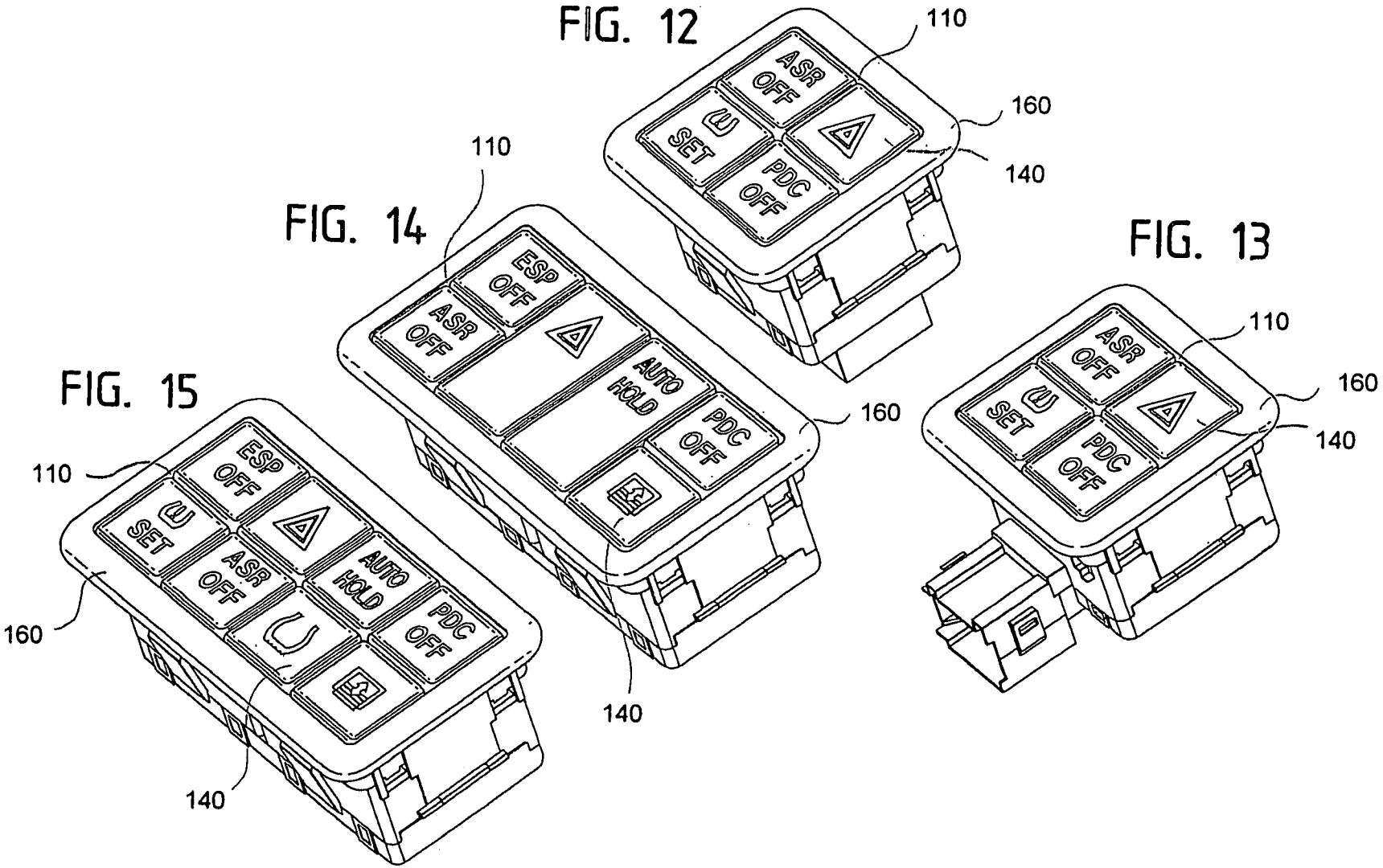
Figure 20:
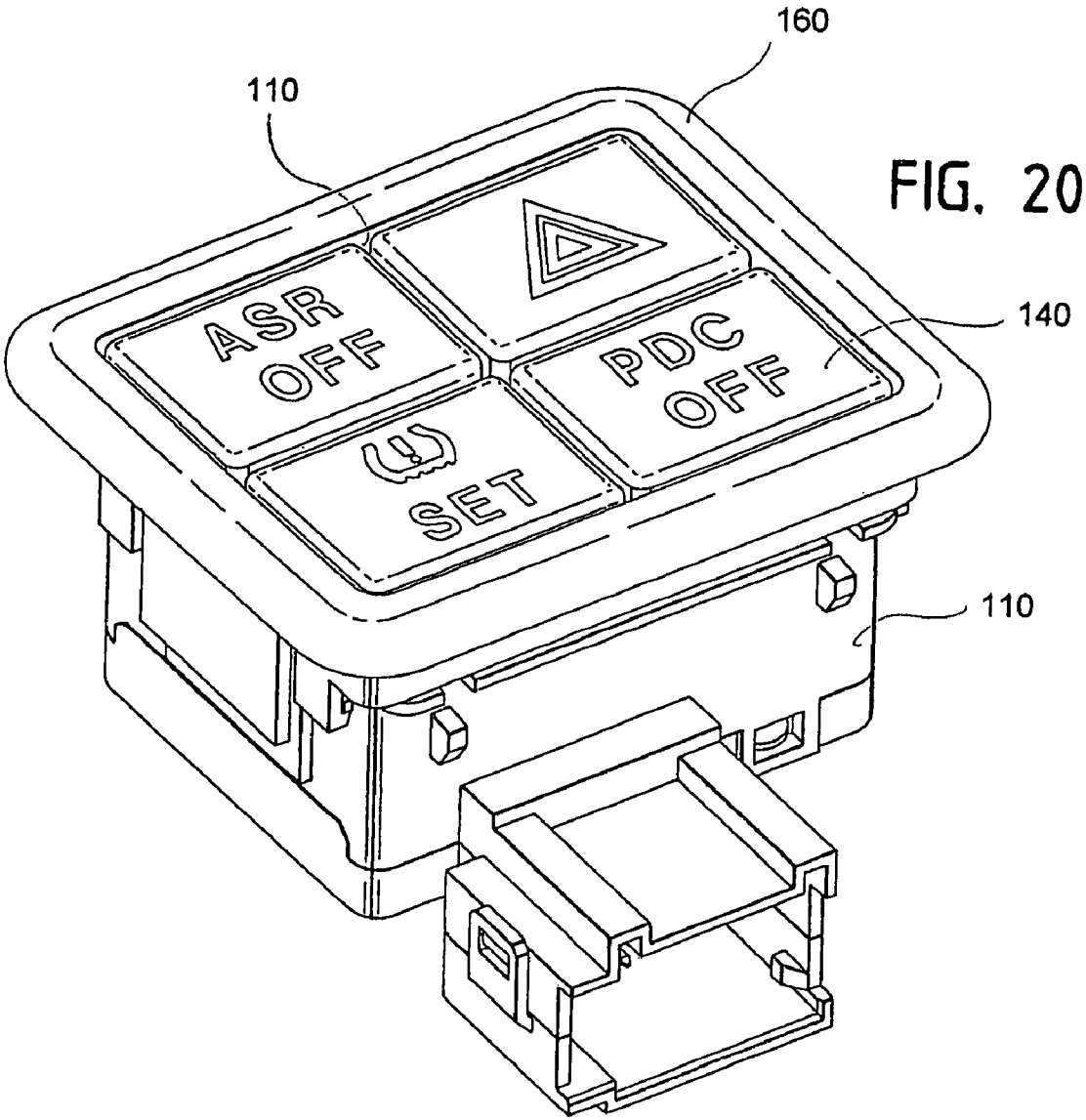
Figure 21:
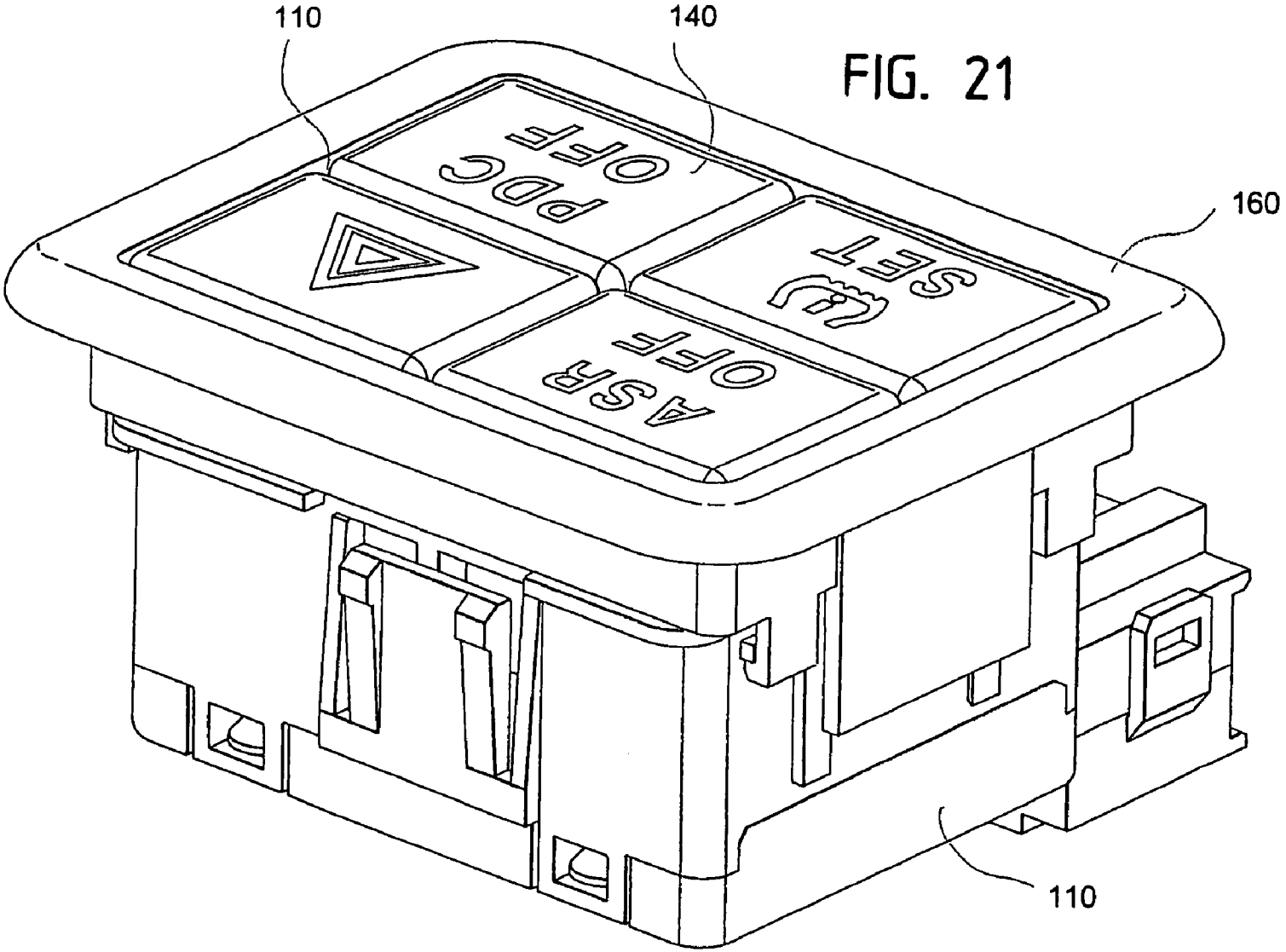
Figure 22:
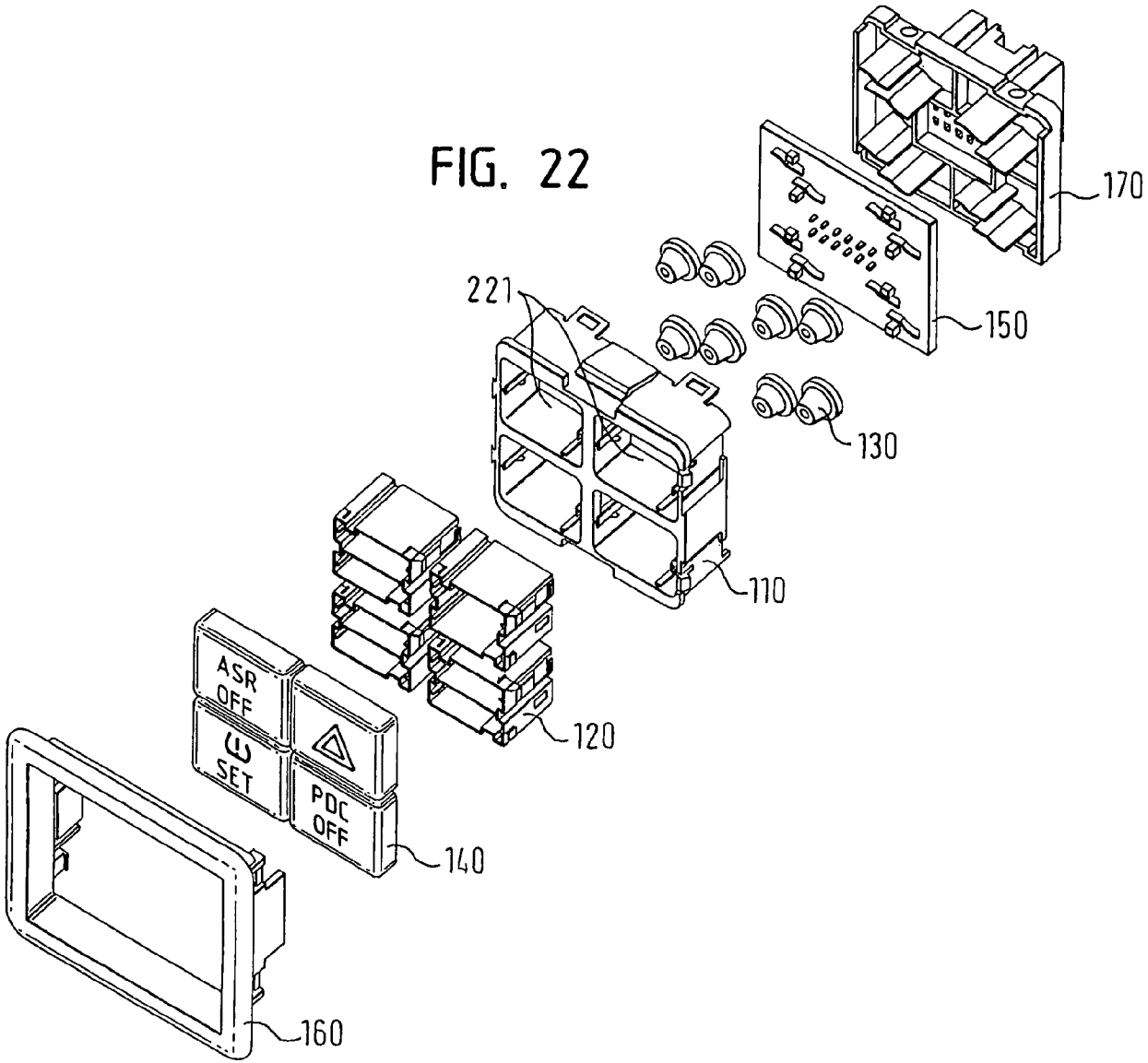
FIG. 22 shows an exploded drawing of an operating element with four operating keys.

An exploded drawing of an operating element according to FIG. 1 is illustrated in FIG. 22. The operating element comprises a housing 110 with four openings or recesses 221, each of which are respectively provided for a guide element 120. Each guide element 120 is displaceable in the opening 221 of the housing 110. Furthermore, contact elements 130 are illustrated, two of which are in each case able to be connected with a guide element 120. Four operating keys 140 are also shown, one operating key 140 respectively being able to be connected with a guide element 120 respectively. The contact elements 130 provide an electrical contact on a plate 150. A closure element 170 and a frame element 160 may be connected respectively with the housing 110, in particular via a detachable clamping connection.

FIG. 1 to FIG. 21 show operating elements in various views with slightly different operating keys 140. For example, FIG. 3 and FIG. 4 respectively show an operating element with eight guide elements 120 (not visible in these figures); the embodiment shown in FIG. 3 having six operating keys 140 and the embodiment shown in FIG. 4 having eight operating keys 140. Accordingly, six functions can be carried out with the operating element according to FIG. 3 and eight functions with the operating element according to FIG. 4. The operating keys 140 for the warning blinker system and the "AUTO HOLD" function in FIG. 3 are respectively connected with two guide elements 120 (not shown in FIG. 3). None of the operating elements shown have blind caps; rather, the whole available operating area of the respective operating element is utilized.

FIGS. 1 to 11 show the operating elements from the front, which is how they would be viewed by an operator, for example the driver of a motor car, and FIGS. 12 to 21 show the operating elements in perspective, with the side walls of the housing 110 visible.

The operating elements according to FIG. 2, FIG. 6, FIG. 13, FIG. 17, FIG. 20 and FIG. 21 respectively have a separate connection piece for the operating element.

Figure 23:
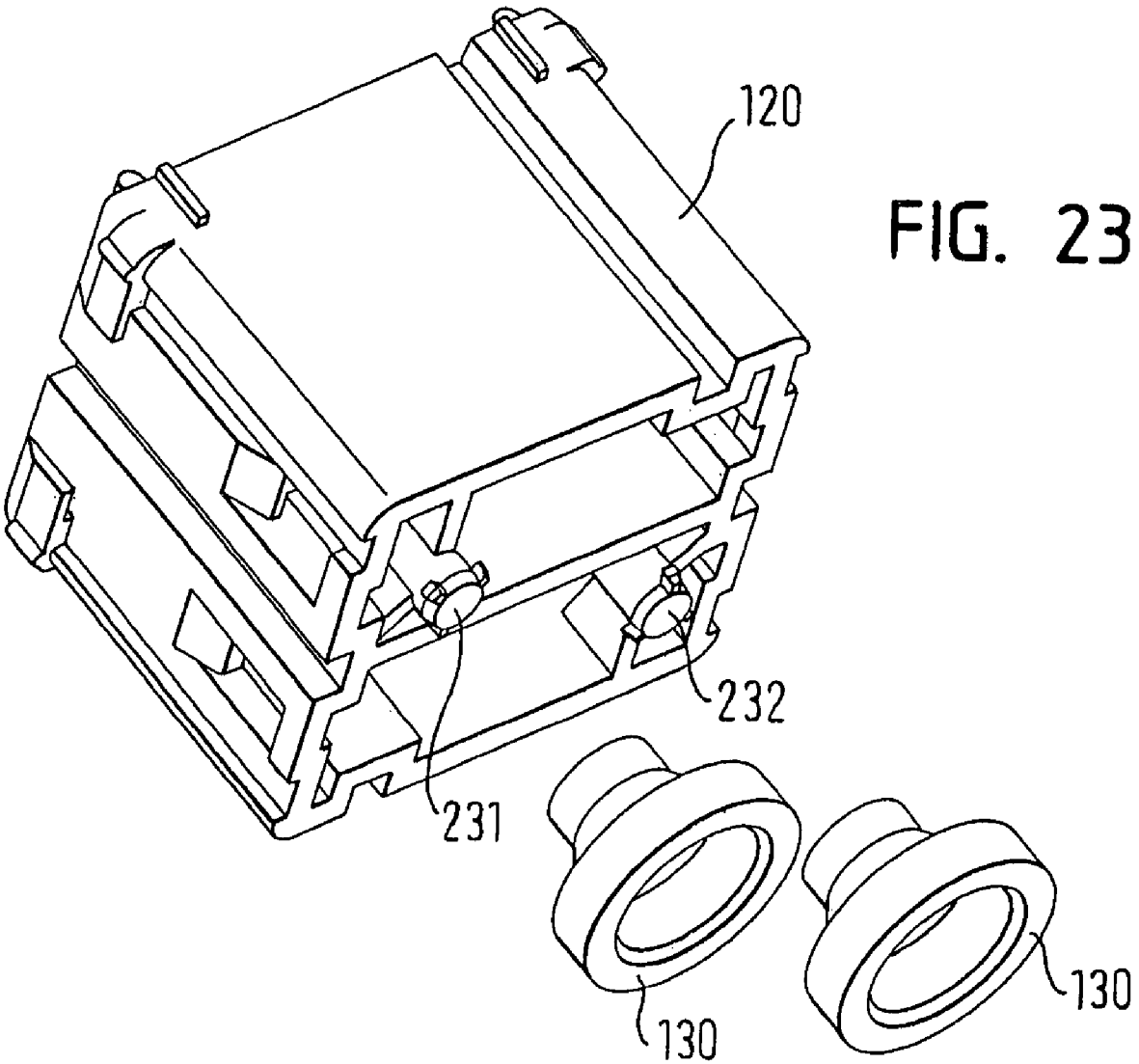
FIG. 23 shows a guide element with two contact elements.

FIG. 23 shows an oblique rearward view of the guide element 120 with two contact elements 130 which may be connected with pins 231 and 232 of the guide element 120. The contact elements 130 are constructed in particular covered with rubber so that an elastic switch path or key path is made possible.

Figure 24:
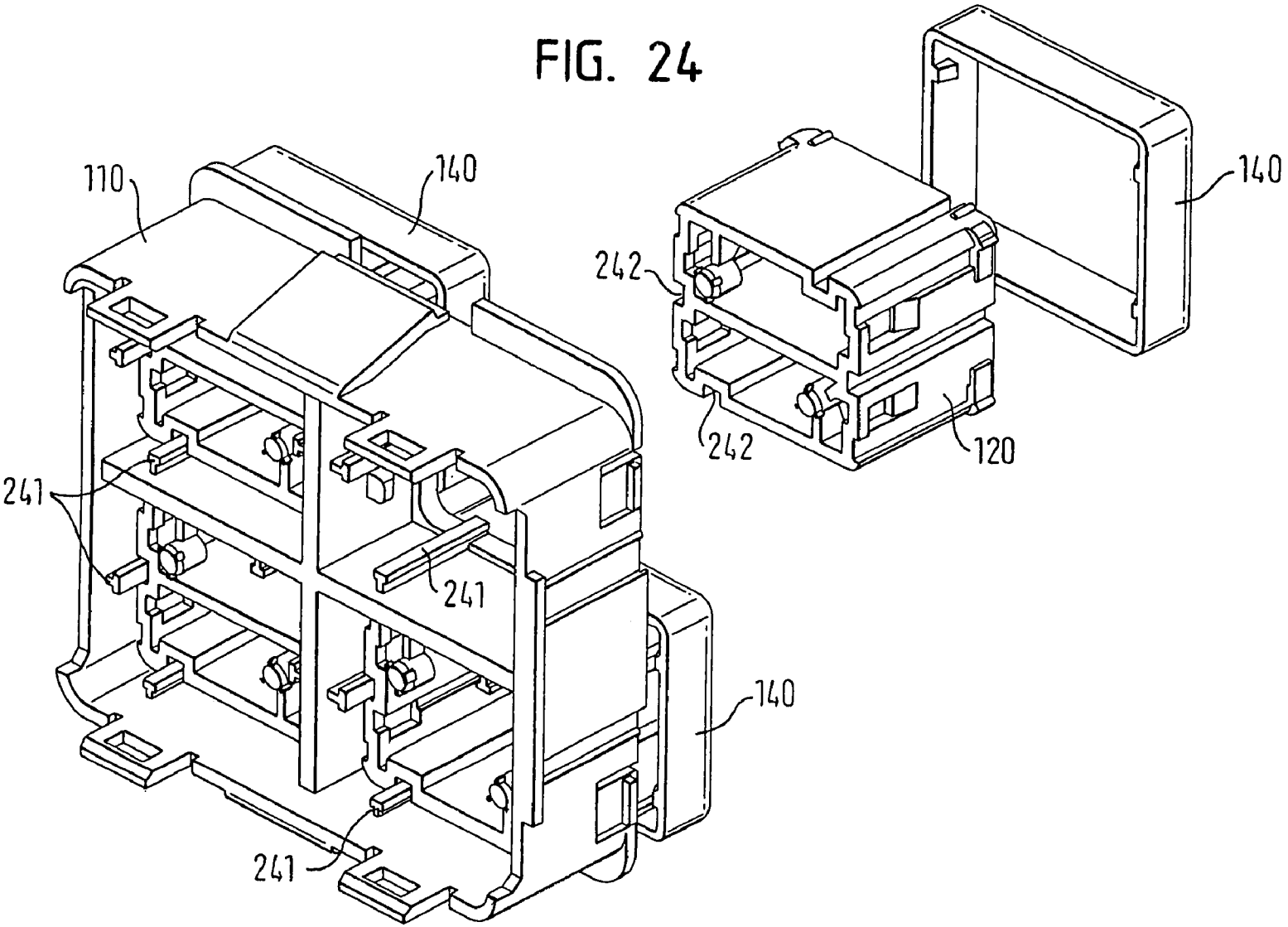
FIG. 24 shows a housing with guide elements and operating keys (rearward view)

FIG. 24 shows a rearward view of the housing 110 with guide elements 120 and operating keys 140. It can be seen hereby how the guide elements 120 are mounted displaceably in the openings of the housing 110. For this, each opening of the housing 110 preferably comprises projections 241 which engage into corresponding grooves 242 of the guide element 120 and therefore ensure or stabilize the guidance along the projections 241 in the housing 110. Alternatively, it is also possible to provide different kinds of guide or to exchange the projection and groove.

Figure 25:
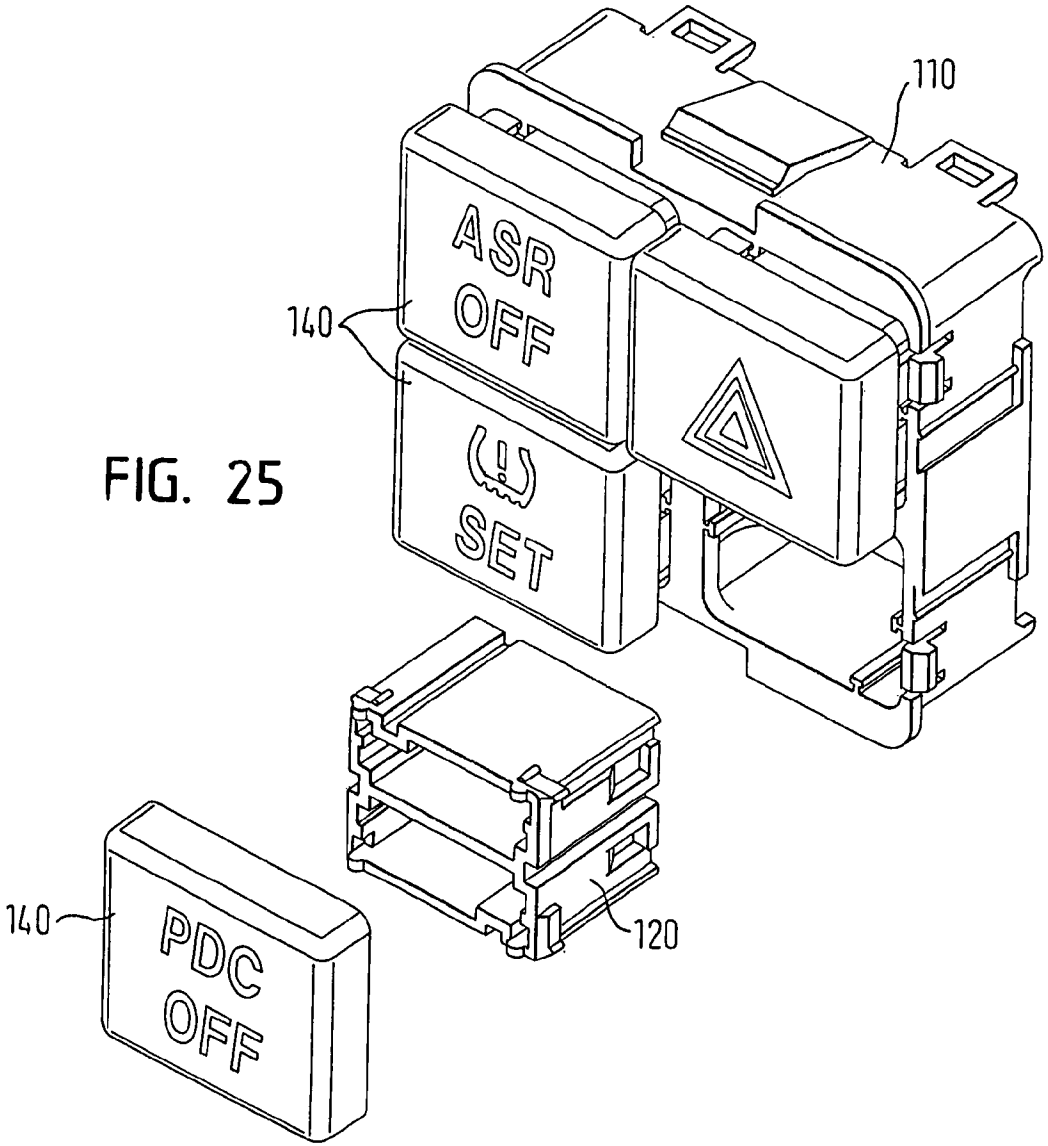
FIG. 25 shows a housing with guide elements and operating keys (oblique view from the front)
Figure 27:
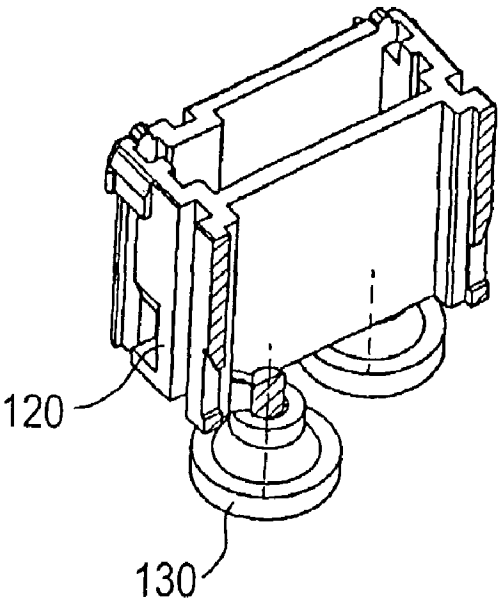
FIG. 26 to FIG. 29 show various views of a guide element with two contact elements.
Figure 26:
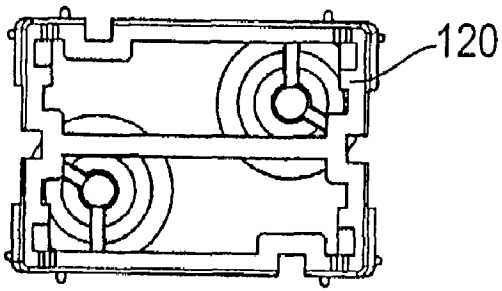
Figure 29:
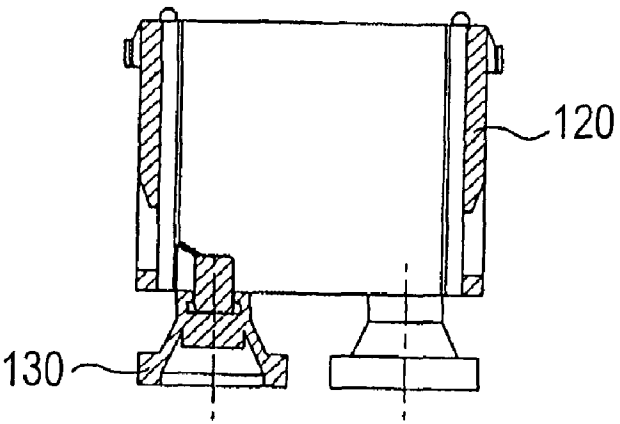
Figure 28:
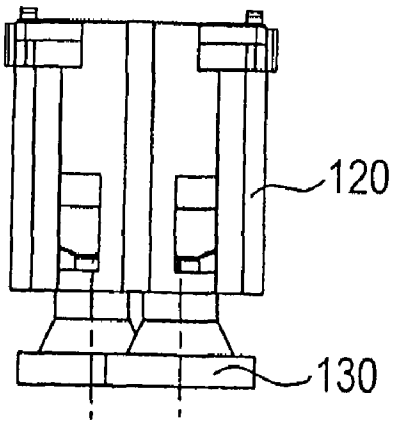
Figure 31:
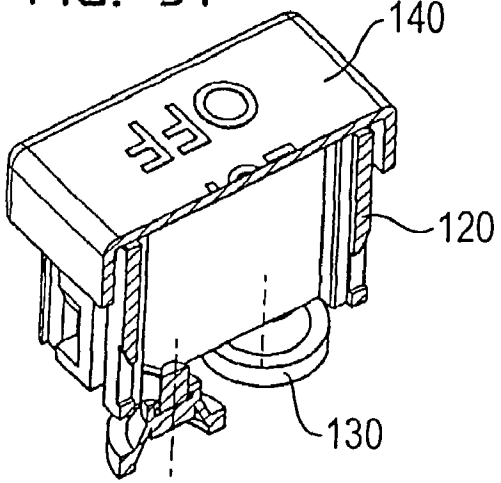
FIG. 30 to FIG. 33 show various views of a guide element with contact elements and operating key.
Figure 30:
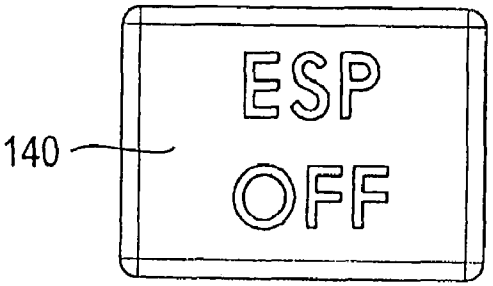
Figure 33:
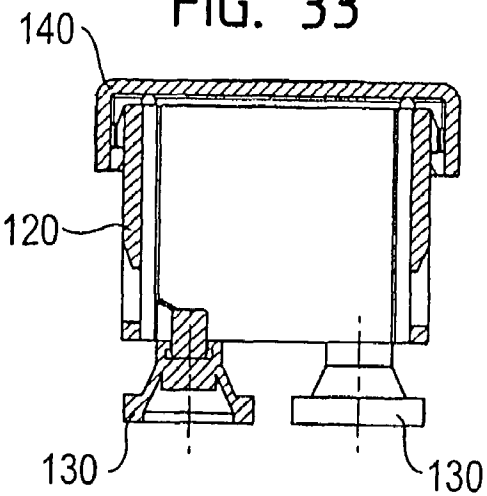
Figure 32:
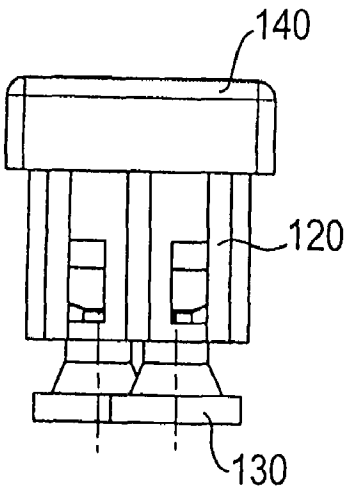

FIG. 25 shows the arrangement of FIG. 24 obliquely from the front. Operating keys 140 are again connected or able to be connected with guide elements 120, such that the guide elements 120 are guided or mounted displaceably in the housing 110.

FIG. 26 to FIG. 29 show various views of the guide element 120 with contact elements 130.

FIG. 30 to FIG. 33 show various views of the guide element 120 with contact elements 130 and an "ESP OFF" operating key 140.

Figure 34:
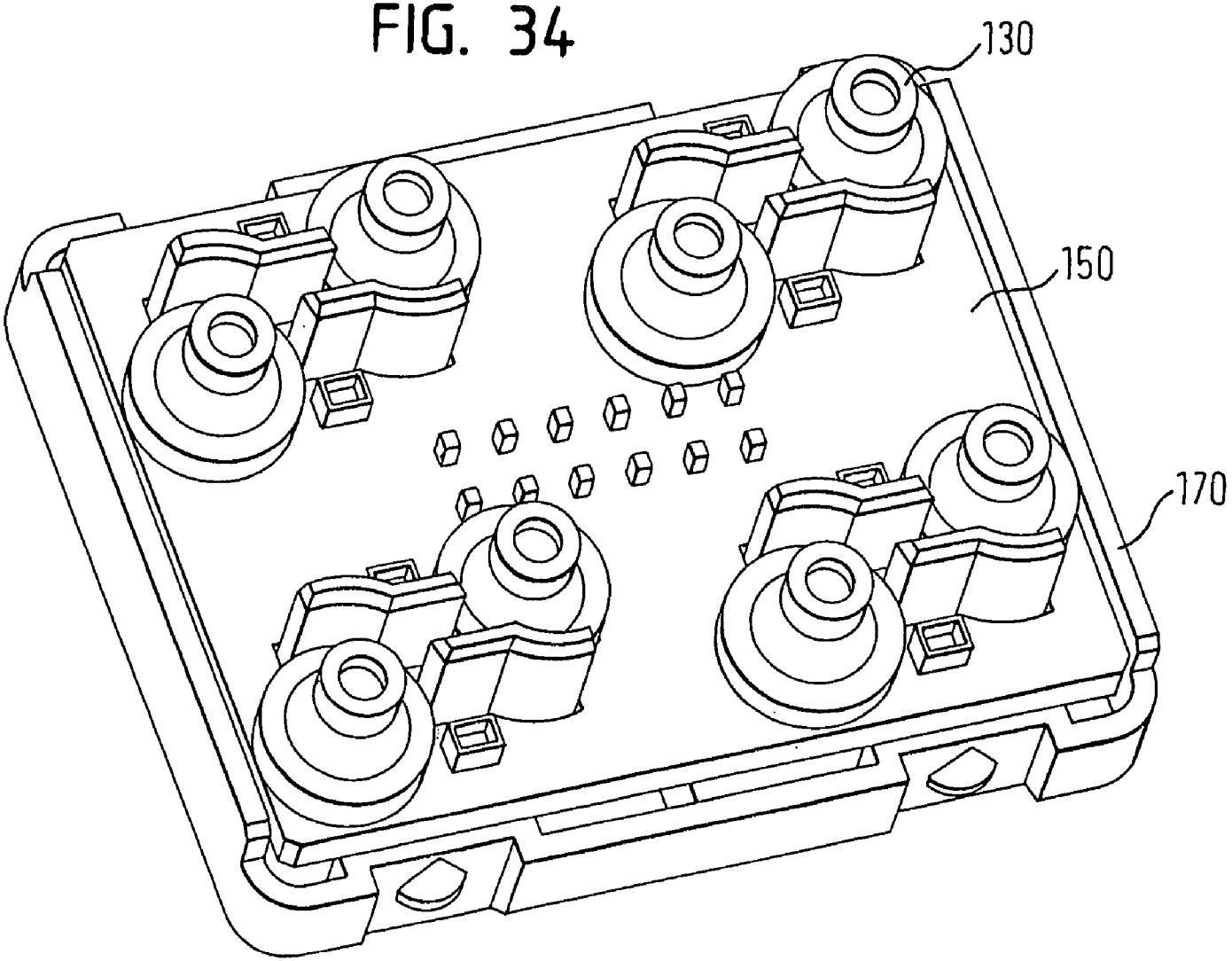
FIG. 34 shows a closure element with plate and contact elements.

FIG. 34 shows the closure element 170 in a state connected to the plate 150. In addition, the contact elements 130 are illustrated on the plate 150.

Figure 35:
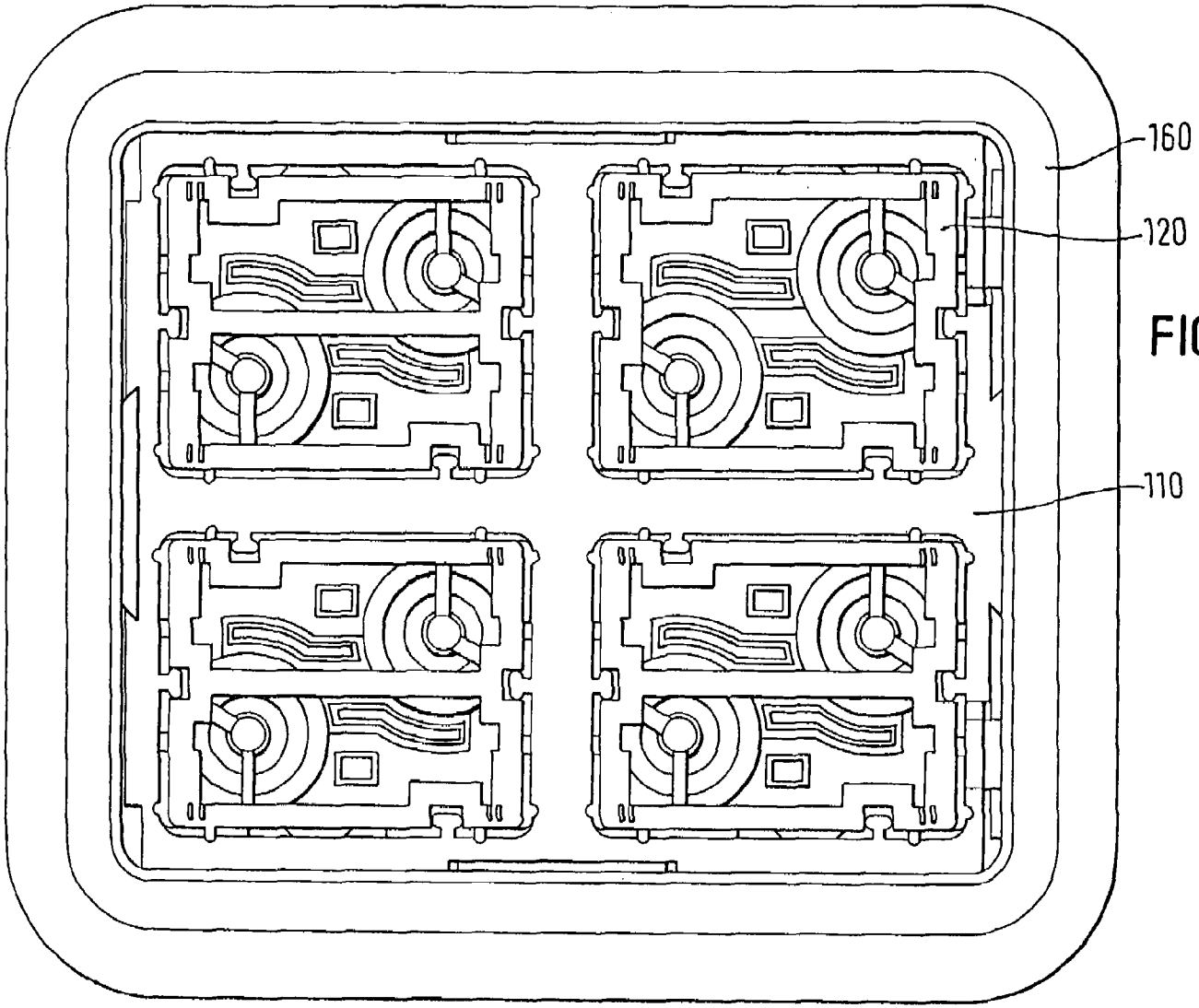
FIG. 35 shows an operating element without operating keys.

FIG. 35 shows the operating part from the viewpoint of the operator but without operating keys. Therefore, the housing 110, which is enclosed by the frame element 160, is visible with the guide elements 120 guided in the openings.

The guide elements 120, illustrated in light shading here, are advantageously produced from a photoconducting material, as so-called reflectors, so that a function illumination of the operating keys (not illustrated in FIG. 35), which are arranged on the guide elements, is ensured. The reflector therefore transports light to the operating key and lies beneath the transparent label (see, for example, "PDC OFF" in FIG. 25) with a background illumination. Alternatively, the operating key may also have a dark label on a transparent background.

FIG. 36 and FIG. 37 show oblique views of a partially assembled operating element, comprising respectively the frame element 160, operating keys 140, guide elements 120, the housing 110 and the closure element 170. Both figures show that the closure element 170 and the frame element 160 are respectively connected with the housing 110 via a clamping construction and that the closure element 170 has a closure element on the rear side, with the aid of which the operating element can be electrically connected.

Figure 38:
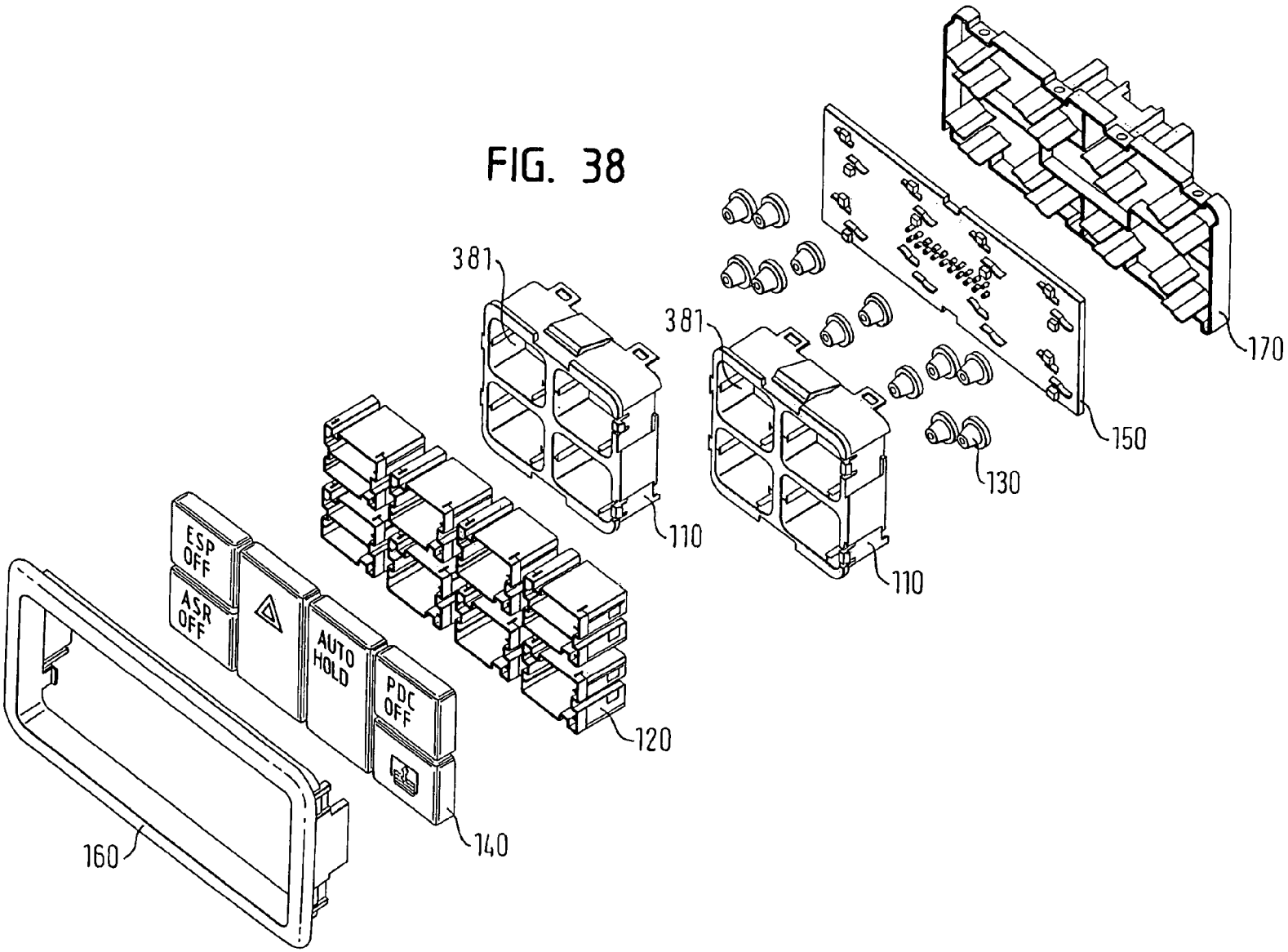
FIG. 38 shows an exploded view of an assembled operating element with eight guide elements.

FIG. 38 shows an assembled operating element with two housings 110 which are able to be plugged together, each of which has four openings 381. In addition, eight guide elements 120 are provided, one for each opening 381 of the assembled operating element. Six operating keys 140 are distributed here to the eight guide elements 120 such that the two central operating keys ("warning blinker system" and "AUTO HOLD") are connected with respectively two guide elements 120 and the other four operating keys are connected with respectively one single guide element 120. Therefore, the two central operating keys are approximately twice as large as the remaining operating keys.

Each operating key is connected with two contact elements 130 via one or two guide elements. Two contact elements 130 are preferably also provided for the two central operating keys which are respectively connected with two guide elements 120.

The plate 150 and the closure element 170 form the rearward side of the operating element. The frame element 160 is connected with the housing 110 on the front side of the operating element (from the viewpoint of the operator).

A comparison of the assembled operating element according to FIG. 38 with the operating element according to FIG. 22 shows that as a whole a high proportion of identical components is able to be used, owing to the housings 110 which are plugged together in FIG. 38. Only the frame element 160, the plate 150 and the closure element 170 are individualized to the size of the operating element, or of the assembled operating element individually. In order to use even more identical components, an assembled operating element could also consist of several operating elements according to FIG. 22. In this case, a new common frame element 160 can be optionally provided.

Figure 39:
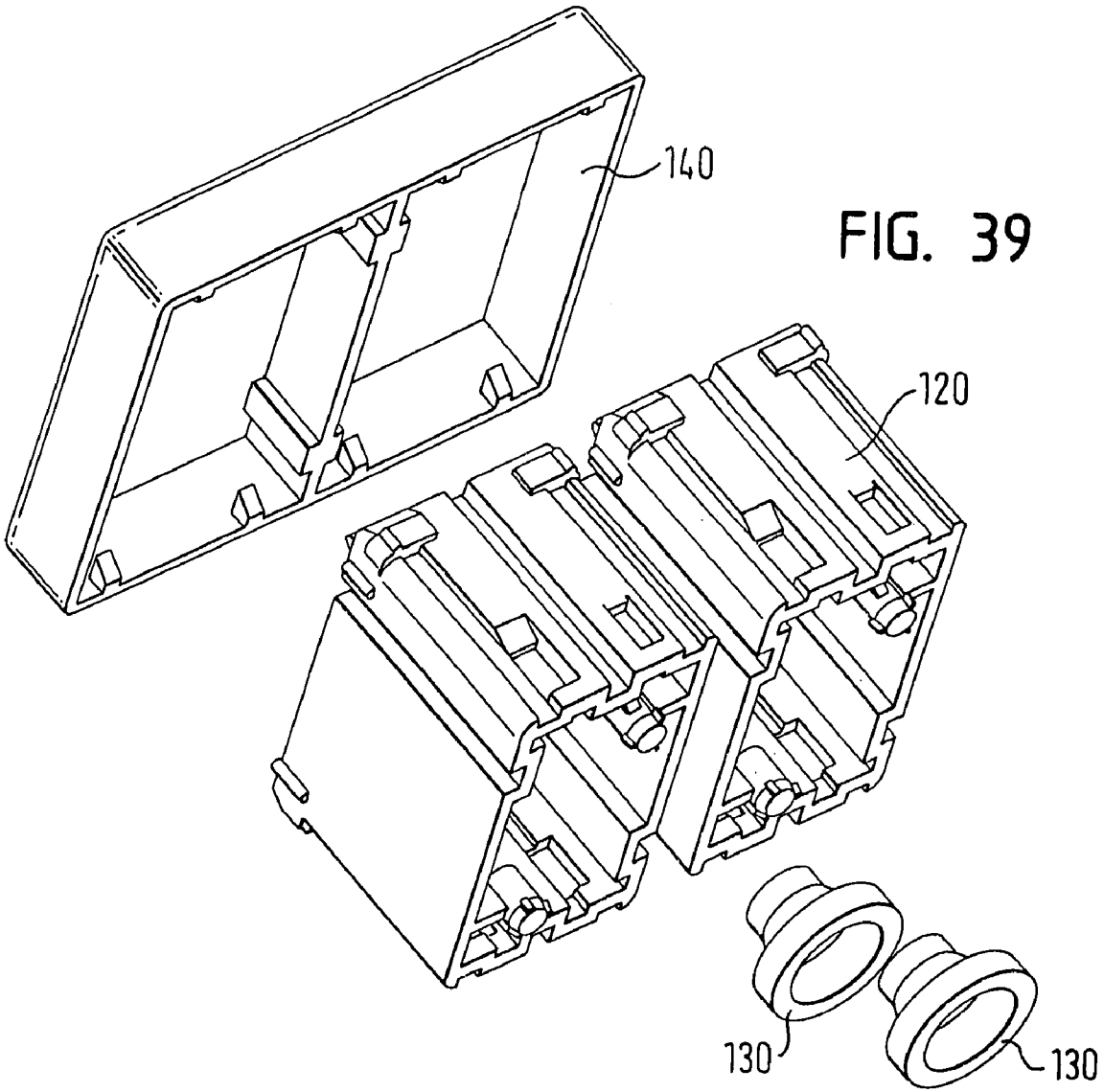
FIG. 39 shows an operating key comprising two guide elements and two contact elements.
Figure 41:
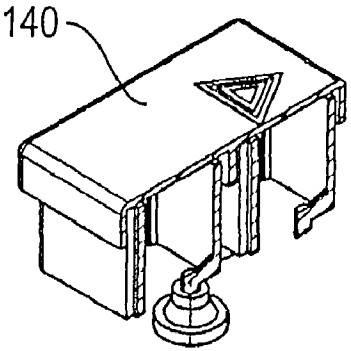
FIG. 40 to FIG. 43 show various views of an operating part with an operating key which is connected with two guide elements.
Figure 43:
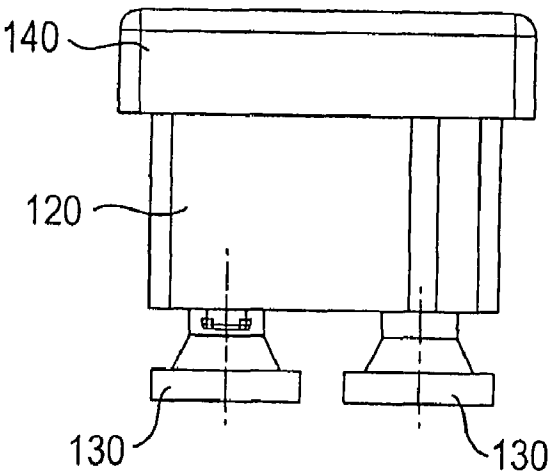
Figure 40:
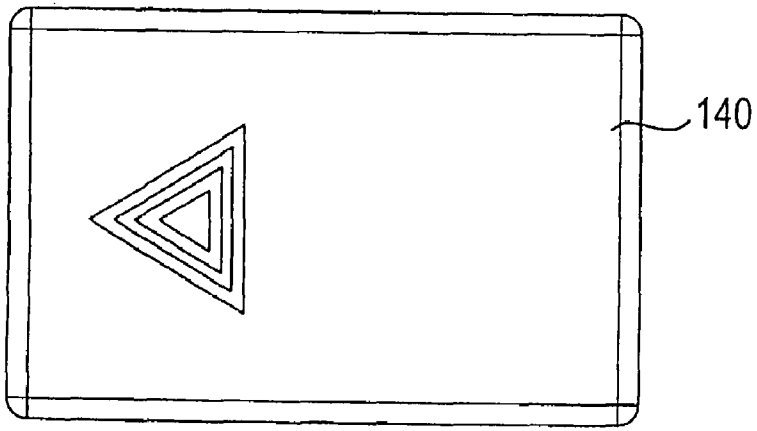
Figure 42:
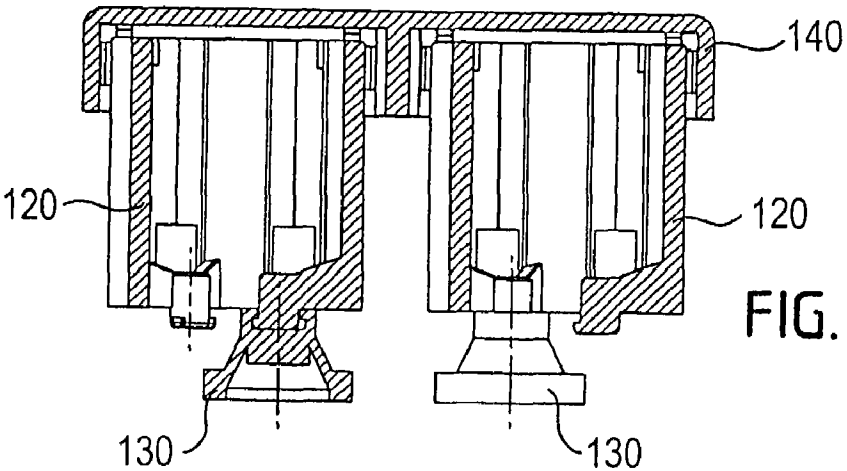

FIG. 39 shows the operating key 140 which is able to be connected with two guide elements 120. In each case, a contact element 130 is able to be connected with a guide element 120. Owing to the two guide elements, the operating key 140 according to FIG. 39 is approximately twice as large as an operating key for only one guide element 120.

According to the reflector functionality of the guide element 120, different function illuminations can be provided for the operating key 140. For example, illuminations of different colours for one guide element 120, respectively, can indicate different functionalities via the operating key 140. An operator can thus distinguish between different functionalities in darkness.

In addition, an optical partitioning of individual illumination units, in this case the reflectors 120, could take place, for example by providing a partition wall between the reflectors. In this way, the illumination of the one reflector can be prevented from influencing the illumination of the other reflector.

FIG. 40 to FIG. 43 show an operating part for two guide elements 120, i.e. a unit of the operating key 130, which is connected here with two guide elements 120, each guide element having a contact element 130.

Figure 44:
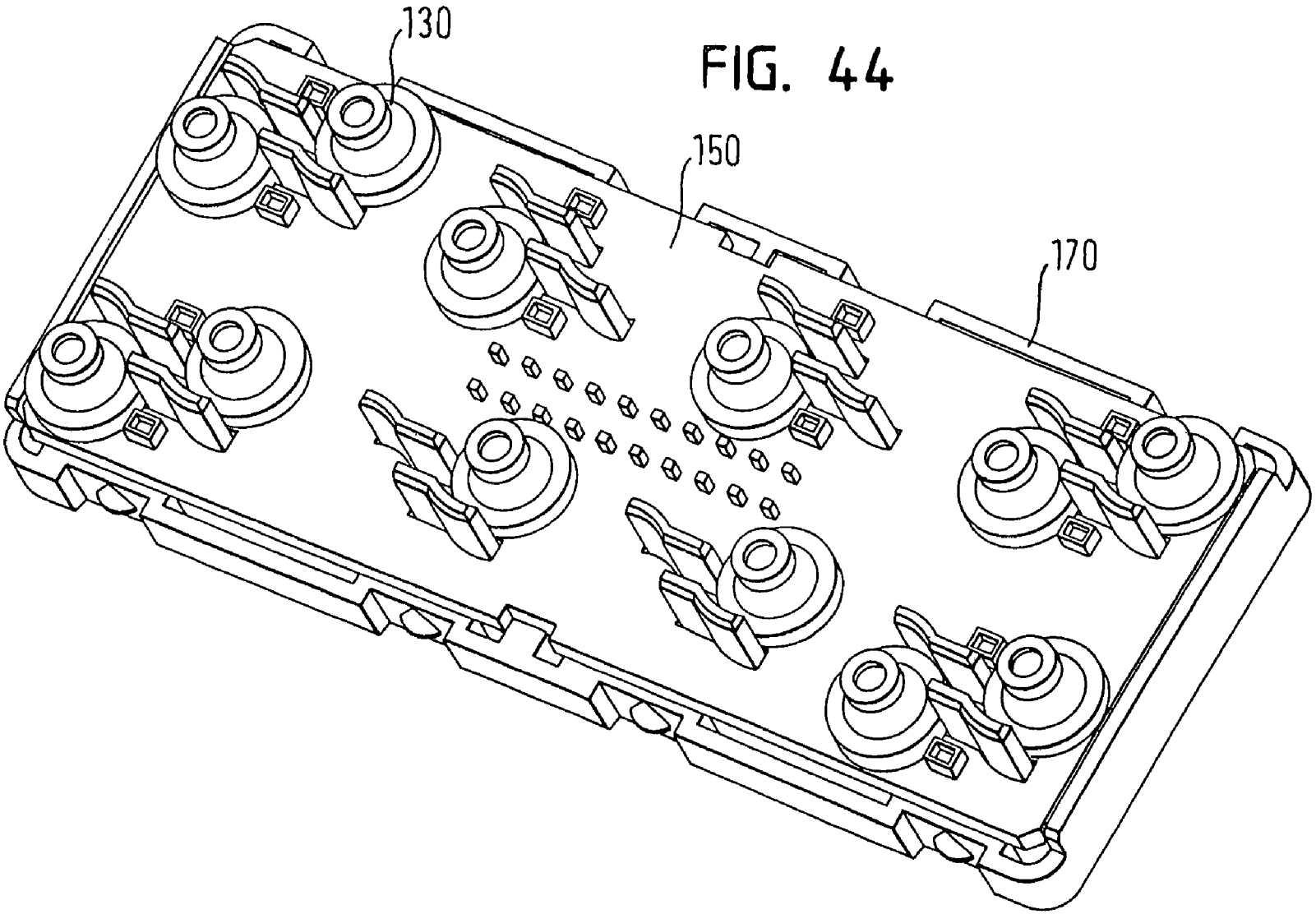
FIG. 44 shows a closure element with a plate and contact elements.

FIG. 44 shows the closure element 170 for an operating element with eight guide elements. The closure element 170 illustrated here is connected with the plate 150 and with contact elements 130.

Figure 45:
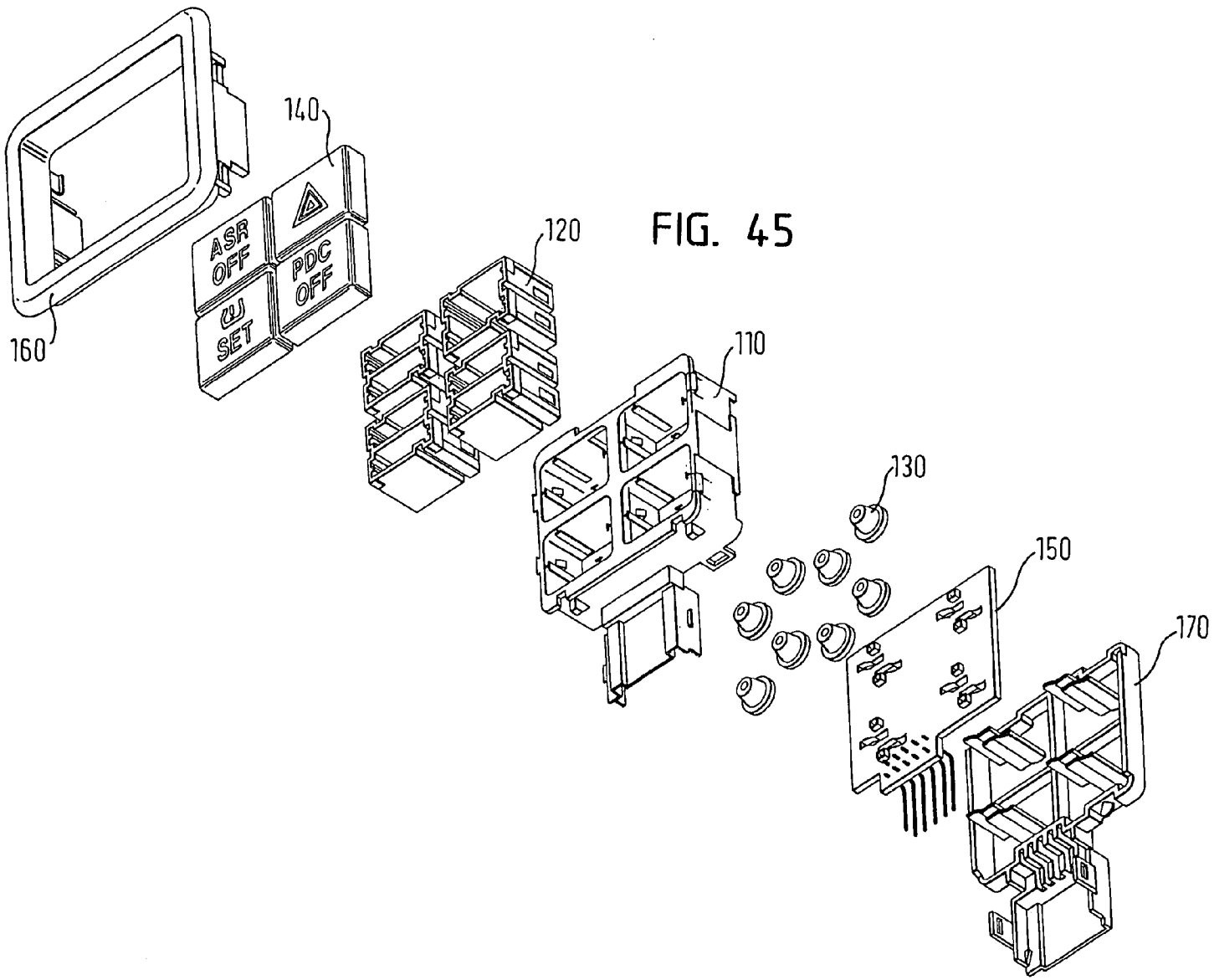
FIG. 45 shows an exploded drawing of an operating element.
Figure 46:
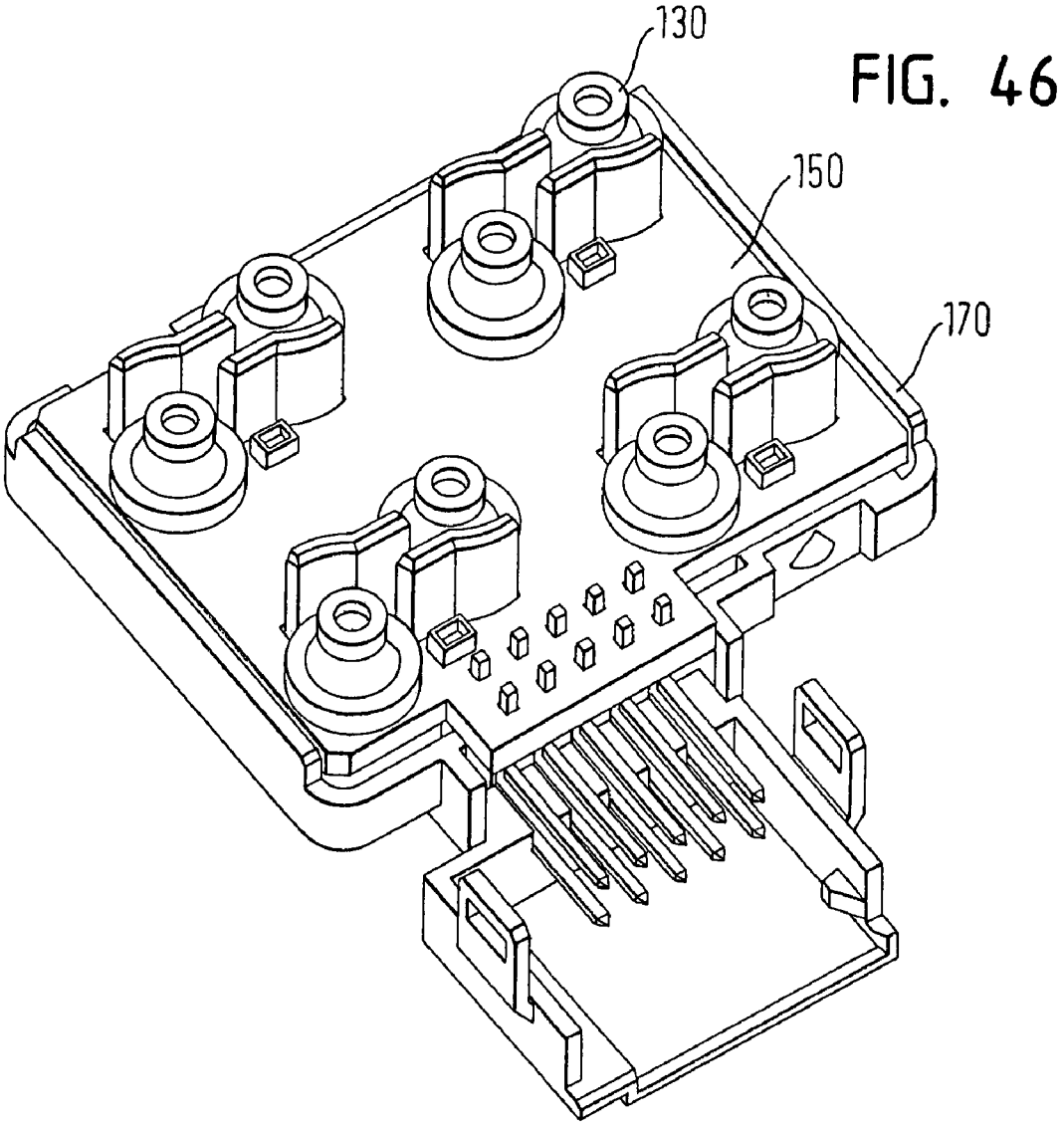
FIG. 46 shows a closure element with a plate and contact elements.
Figure 47:
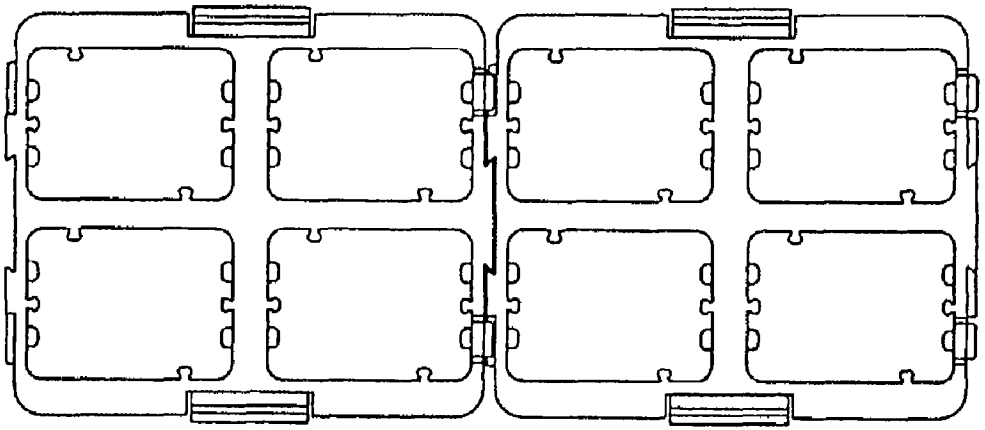
FIG. 47 to FIG. 52 show housings which are able to be plugged together.
Figure 48:
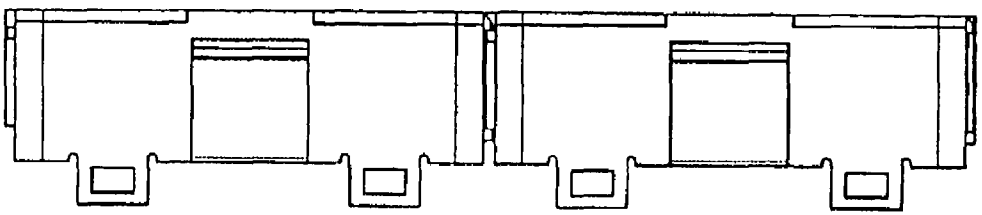
Figure 49:
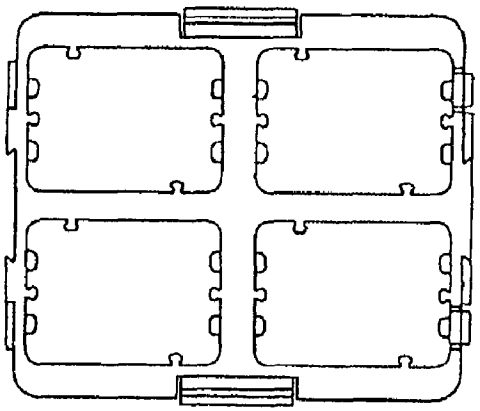
Figure 51:
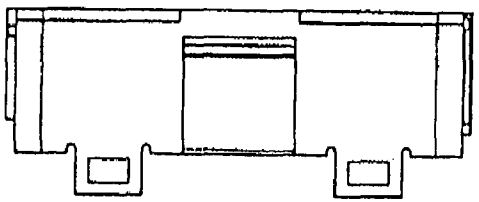
Figure 52:
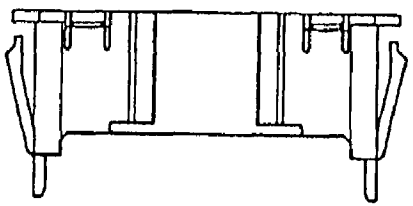
Figure 50:
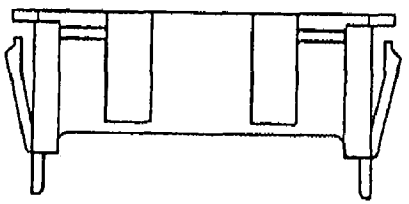

FIG. 45 shows an exploded illustration of an operating element with four guide elements similar to FIG. 22. The housing 110, the plate 150 and the closure element 170 represent a possibility for plug contacting of the operating element towards the bottom.

FIG. 47 to FIG. 52 show various views of a single housing, which is able to be plugged together with another housing, or of two housings that have been plugged together. Through the connection of the housings, for example by means of a dovetail joint, it is possible to provide modular units of any desired size. For example, a size of housing with four openings for four guide elements is shown here. Alternatively, any desired size of housing can be combined in turn with other housings of any desired size.

Figure 54:
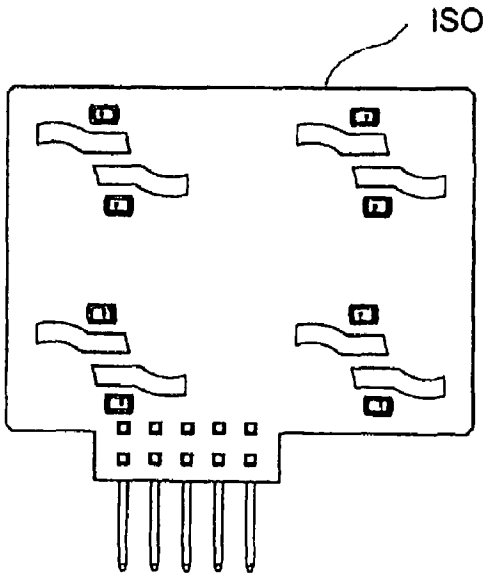
FIG. 53 to FIG. 55 show contacting plates for various operating elements.
Figure 53:
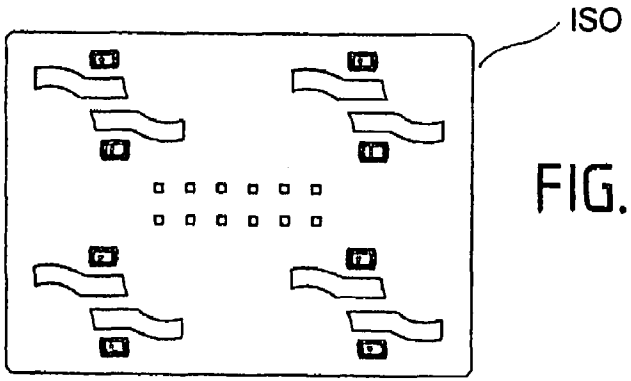
Figure 55:
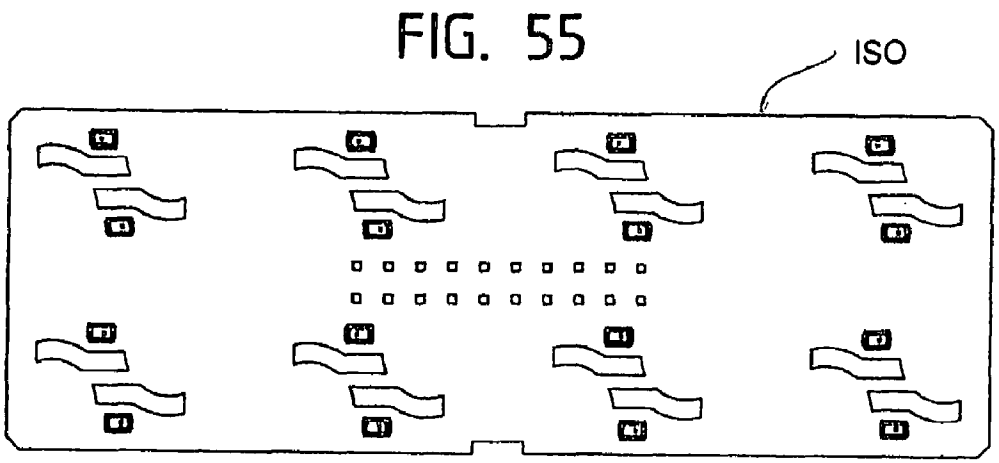

FIG. 53 to FIG. 55 show plates 150 for various operating elements, which are explained above. The plates 150 can be made to any size, so as to be adaptable for use with the required number of operating elements.

The invention claimed is:

1. A module operating switch assembly, comprising a housing defining a plurality of switch operating cells, each of said operating cells having guide walls, a switch actuating member in sliding contact with said guide walls, a contact element connected with said switch actuating member, and a switch contact carrier configured to be selectively equipped with contact pairs such that each of said contact pairs is associated with at least one of said switch actuating members, each of said switch actuating members being operable to be selectively connected to a key cap associated with a single switch operating cell or with a key cap associated with a plurality of adjacent ones of the switch operating cells, wherein in the case where said key cap is associated with a plurality of adjacent ones of the switch operating cells, the contact pairs associated with said plurality of adjacent ones of the switch operating cells are assigned to a single functionality and cooperate with the contact elements connected to the switch actuating members of said plurality of adjacent ones of the switch operating cells.

2. The switch assembly according to claim 1, wherein one of the contact pairs is associated with each of the switch operating cells.

3. The switch assembly according to claim 1, wherein one of the key caps is associated with two adjacent switch operating cells.

4. The switch assembly according to claim 1, wherein each of the switch actuating members is constructed as a reflector.

5. The switch assembly according to claim 1, further comprising an illumination means provided in the key caps.

6. The switch assembly according to claim 1, wherein 2, 4, 6 or 8 switch operating cells are provided in said housing.

7. The switch assembly according to claim 1, wherein said housing comprises an engagement means operable to engage with a corresponding engagement means provided on another said housing.

8. A module operating switch assembly, comprising a housing defining a plurality of switch operating cells, each of said operating cells having guide walls, a switch actuating member in sliding contact with said guide walls, and a switch contact carrier configured to be selectively equipped with contact pairs, at least two contact elements being associated with one of said switch actuating members and cooperating with the contact pairs, each of said switch actuating members being operable to be selectively connected to a key cap associated with a single switch operating cell or with a key cap associated with a plurality of adjacent switch operating cells.

9. The switch assembly according to claim 8, wherein one of the key caps is associated with two adjacent switch operating cells.

10. The switch assembly according to claim 8, wherein each of the switch actuating members is constructed as a reflector.

11. The switch assembly according to claim 8, further comprising an illumination means provided in the key caps.

12. The switch assembly according to claim 8, wherein 2, 4, 6 or 8 switch operating cells are provided in said housing.

13. The switch assembly according to claim 8, wherein said housing comprises an engagement means operable to engage with a corresponding engagement means provided on another said housing.

14. A module operating switch assembly, comprising:

a housing defining switch operating cells, each of said operating cells having guide walls;

switch actuating members in sliding contact with said guide walls, said switch actuating members being connectable to a single key cap;

contact elements connected with said switch actuating members; and a switch contact carrier having contact pairs that cooperate with said contact elements, each of said contact pairs being associated with one of said switch actuating members, said contact pairs being assigned to a single functionality.

15. The switch assembly according to claim 14, wherein said housing is connectable to another housing.

16. A module operating switch assembly, comprising:

a housing defining a switch operating cell having guide walls;

a switch actuating member in sliding contact with said guide walls;

contact elements connected with said switch actuating member; and a switch contact carrier having a contact pair that cooperates with each of said contact elements, said housing defining a plurality of switch operating cells having guide walls, a plurality of switch actuating members being in sliding contact with the guide walls, a plurality of contact elements are connected with each one of said plurality of switch actuating members, said switch contact carrier having a plurality of contact pairs cooperating with said plurality of contact elements.

17. A switch assembly according to claim 16 wherein a single key cap is connectable to a plurality of said switch actuating members.

18. The switch assembly according to claim 16, wherein said housing is connectable to another housing.

* * * * *